US005324130A

United States Patent [19]

DeJean, Jr.

[11] Patent Number: 5,324,130

[45] Date of Patent: Jun. 28, 1994

[54] ENVELOPE MOISTENING AND SERVICE APPARATUS WITH KNIFE AND INK STAMP

[76] Inventor: Justin F. DeJean, Jr., Black Creek Apt. #3E, PO Box 181, West Park, N.Y. 12493

[21] Appl. No.: 48,317

[22] Filed: Apr. 19, 1993

[51] Int. Cl.[5] ..... B43K 29/00; B43K 29/06; B43K 29/18

[52] U.S. Cl. ..... 401/195; 7/160; 101/333; 401/131; 401/202

[58] Field of Search ..... 401/131, 52, 195, 202; 7/160; 101/333

[56] References Cited

U.S. PATENT DOCUMENTS

| | | | |
|---|---|---|---|
| 697,548 | 4/1902 | Schwab | 401/198 |
| 878,420 | 2/1908 | O'Sullivan | 101/333 |
| 902,671 | 11/1908 | Mauk | 401/202 |
| 1,554,517 | 9/1925 | O'Neill | 401/195 X |
| 1,725,064 | 8/1929 | Easton | 401/195 X |
| 2,778,306 | 1/1957 | Harris | 101/333 |

*Primary Examiner*—Steven A. Bratlie
*Attorney, Agent, or Firm*—E. Michael Combs

[57] ABSTRACT

A support base includes a housing tube, with the housing tube arranged to receive a reservoir tubular member having a fluid permeable tip at one end thereof and a removable cap at a second end thereof permitting replenishment of water within the reservoir, wherein the tip permits moistening of water activated glue portions of an envelope and permitting the moistening of stamps and the like positioned on the envelope.

1 Claim, 4 Drawing Sheets

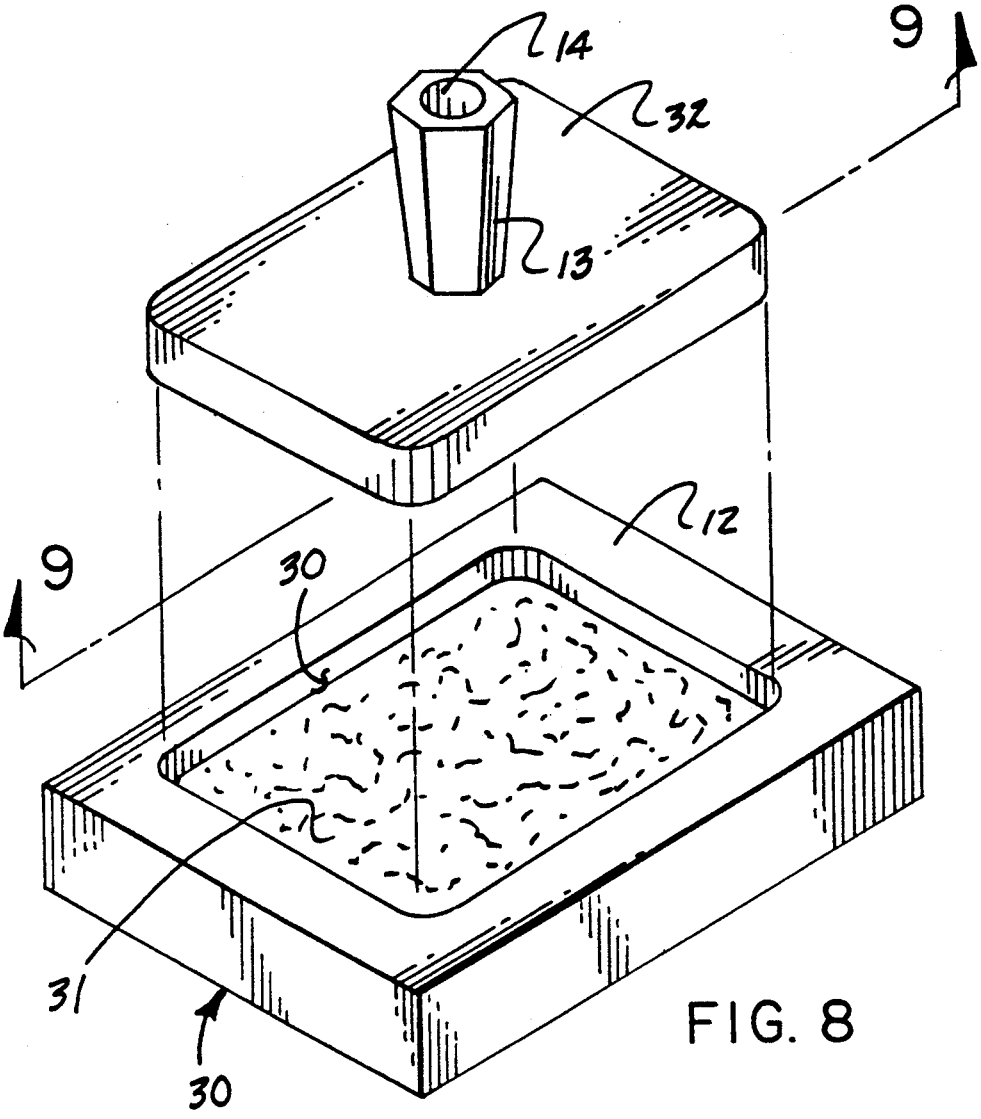
FIG. 8
FIG. 9
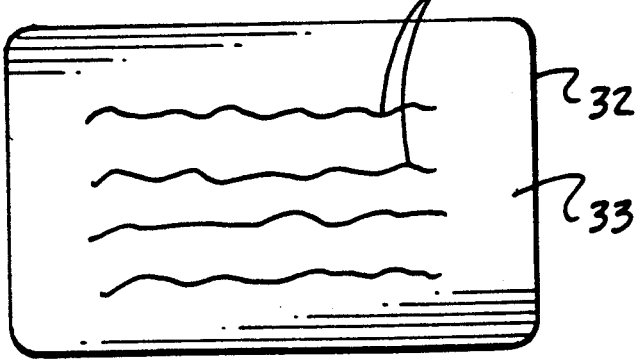

ENVELOPE MOISTENING AND SERVICE APPARATUS WITH KNIFE AND INK STAMP

BACKGROUND OF THE INVENTION

1. Field of the Invention

The field of invention relates to envelope moistening apparatus, and more particularly pertains to a new and improved envelope moistening and service apparatus wherein the same is arranged to permit the ease of moistening and servicing of envelopes.

2. Description of the Prior Art

An envelope moistening structure is indicated in U.S. Pat. No. 5,037,226 to Davis wherein a housing includes a tip member that is inserted within the housing permitting the sponge-like tip to receive water for the moistening and the like.

U.S. Pat. Nos. 5,024,180 and 4,771,727 are further examples of stamp and envelope moistening structure.

U.S. Pat. No. 4,428,794 to Hayskar, et al. sets forth a conveyor belt structure to activate adhesive upon an envelope structure.

As such, it may be appreciated there continues to be a need for a new and improved envelope moistening and service apparatus as set forth by the instant invention addressing both the problems of ease of use as well as effectiveness in construction in moistening of water activated adhesive upon an envelope and stamp structure and in this respect, the present invention substantially fulfills this need.

SUMMARY OF THE INVENTION

In view of the foregoing disadvantages inherent in the known types of envelope moistening apparatus now present in the prior art, the present invention provides an envelope moistening and service apparatus permitting the ease of manipulation of a tubular reservoir for the moistening of water activated adhesive upon an envelope structure. As such, the general purpose of the present invention, which will be described subsequently in greater detail, is to provide a new and improved envelope moistening and service apparatus which has all the advantages of the prior art envelope moistening apparatus and none of the disadvantages.

To attain this, the present invention provides a support base including a housing tube, with the housing tube arranged to receive a reservoir tubular member having a fluid permeable tip at one end thereof and a removable cap at a second end thereof permitting replenishment of water within the reservoir, wherein the tip permits moistening of water activated glue portions of an envelope and permitting the moistening of stamps and the like positioned on the envelope.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basic for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved envelope moistening and service apparatus which has all the advantages of the prior art envelope moistening apparatus and none of the disadvantages.

It is another object of the present invention to provide a new and improved envelope moistening and service apparatus which may be easily and efficiently manufactured and marketed.

It is a further object of the present invention to provide a new and improved envelope moistening and service apparatus which is of a durable and reliable construction.

An even further object of the present invention is to provide a new and improved envelope moistening and service apparatus which is susceptible of a low cost of manufacture with regard to both materials and labor, and which accordingly is then susceptible of low prices of sale to the consuming public, thereby making such envelope moistening and service apparatus economically available to the buying public.

Still yet another object of the present invention is to provide a new and improved envelope moistening and service apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a modified base member of the invention.

FIG. 9 is an orthographic view, taken along the lines 9—9 of FIG. 8 in the direction indicated by the arrows.

DESCRIPTION OF THE PREFERRED EMBODIMENT

Figure 1:
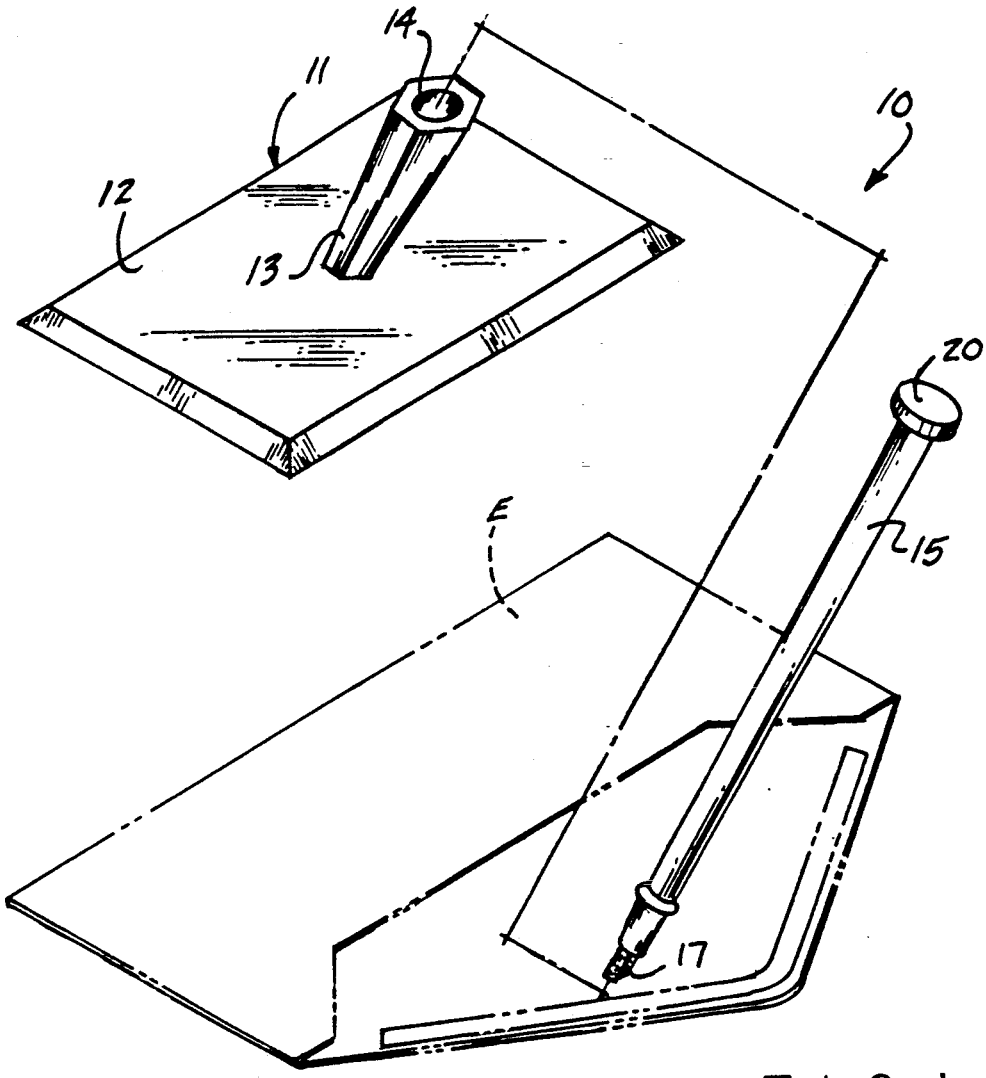
FIG. 1 is an isometric illustration of the invention relative to the use of an associated envelope.
Figure 2:
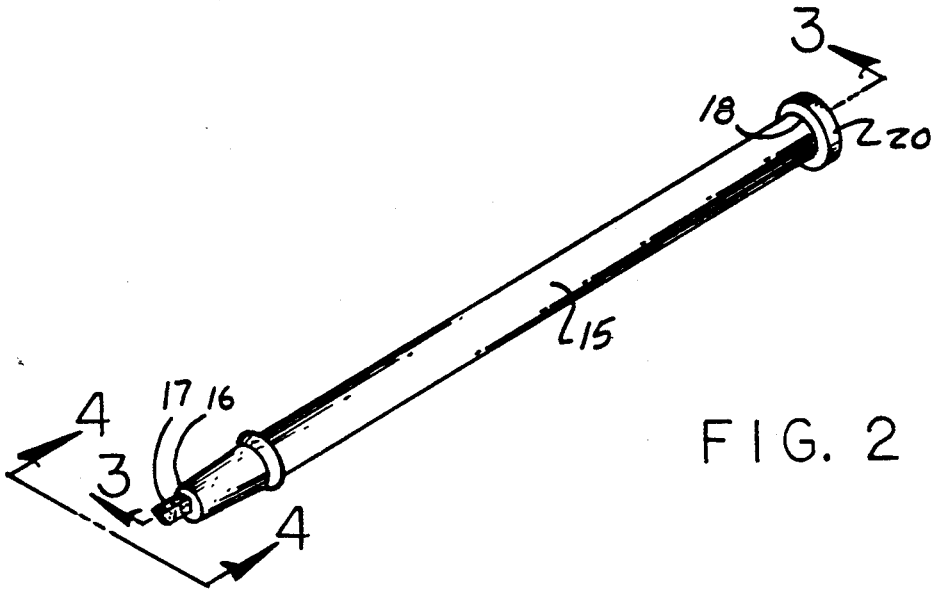
FIG. 2 is an isometric illustration of the pen tube.

With reference now to the drawings, and in particular to FIGS. 1 to 9 thereof, a new and improved envelope moistening and service apparatus embodying the principles and concepts of the present invention and generally designated by the reference numeral 10 will be described.

More specifically, the envelope moistening and service apparatus 10 of the instant invention essentially comprises a base member 11 having a base member top wall, with a support tube 13 directed from the top wall, having a socket cavity 14 to receive a pen tube 15 therewithin. The pen tube is arranged to include first end 16 having a fluid permeable wick 17 extending therefrom, with the socket cavity 14 arranged to complementarily receive the pen tube and the first end 16 therewithin to sealingly engage the first end 16 within the socket cavity 14 preventing evaporation from the wick 17. In lieu of a wick, such as a sponge member and the like, a brush member 17*a* (see FIG. 5) may be employed.

Figure 3:
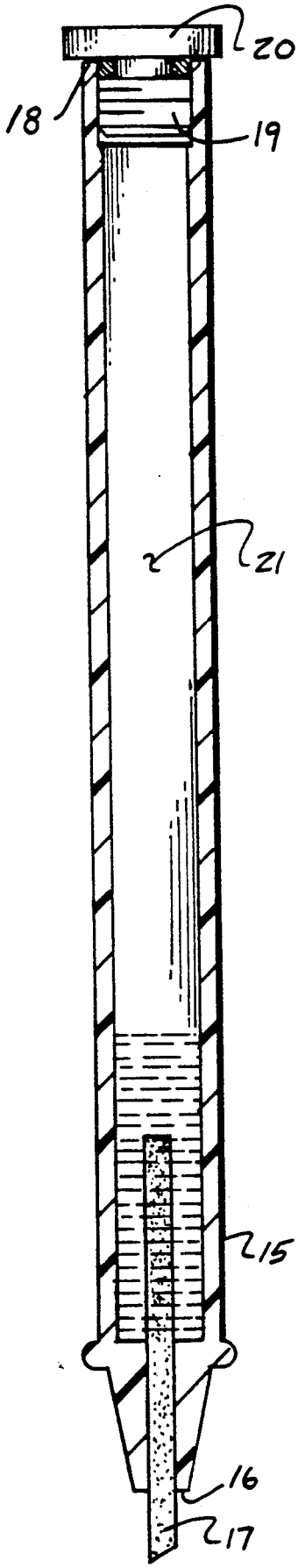
FIG. 3 is an orthographic view, taken along the lines 3—3 of FIG. 2 in the direction indicated by the arrows.
Figure 4:
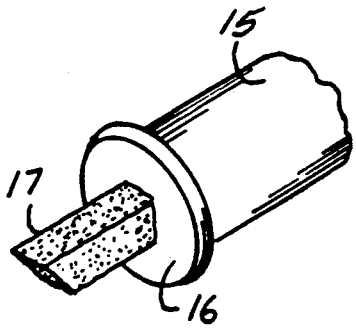
FIG. 4 is an enlarged isometric illustration of the tip structure of the pen tube.
Figure 5:
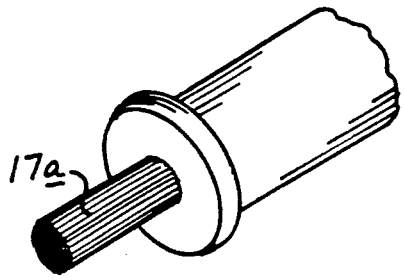
FIG. 5 is an isometric illustration of a modified tip structure of the pen tube.

The pen tube includes a pen tube second end 18, having an end plug 19 arranged to include a threaded exterior surface for threaded engagement within the second end of the pen tube, with a head member 20 mounted to the plug 19 to provide for an abutment upon projection of the plug 19 within the pen tube second end 18. A fluid reservoir cavity 21 is directed between the plug 19 and the first end 16 containing water therewithin for application to water activated adhesive upon the envelope "E". The wick 17 is further arranged for projection across a postage stamp and the like for moistening the same. The configuration of the elongate cylindrical pen tube structure is arranged for ease of manipulation and support in use. As indicated in FIG. 3, the wick 17 is directed through the first end into the reservoir in fluid communication with the water therewithin.

Figure 6:
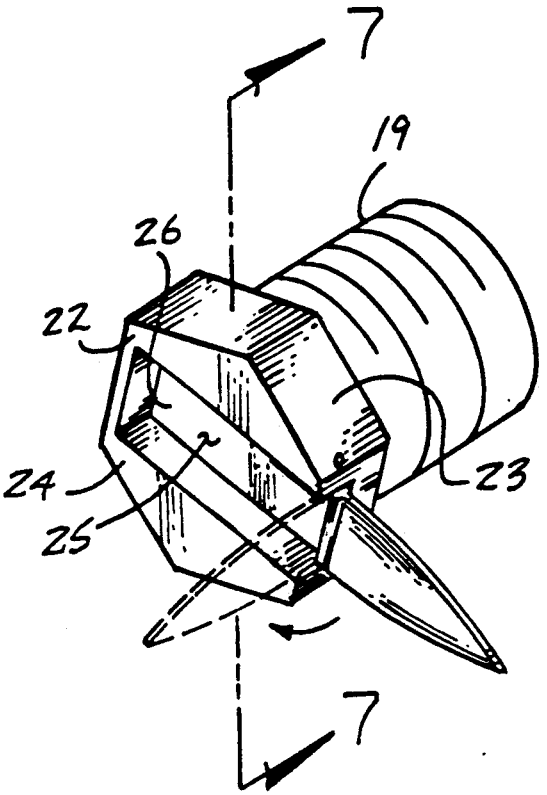
FIG. 6 is an isometric illustration of a modified plug member directed into the second end of the pen tube.
Figure 7:
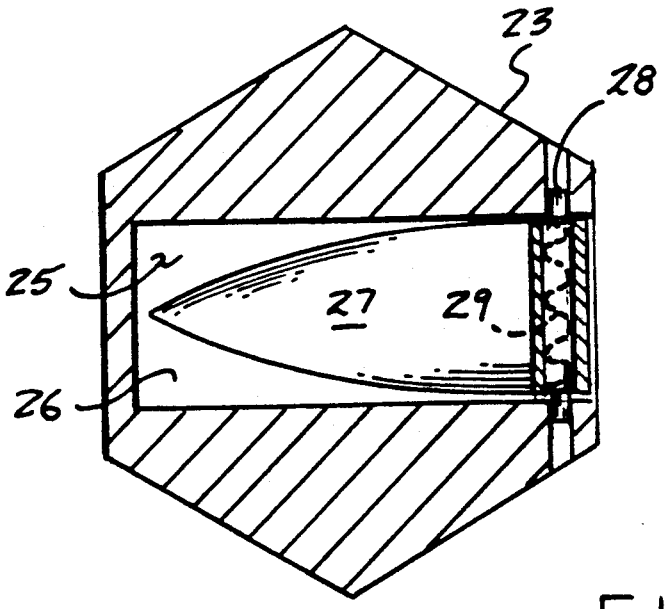
FIG. 7 is an orthographic view, taken along the lines 7—7 of FIG. 6 in the direction indicated by the arrows.

A modified head member 22 is indicated in the FIGS. 6 and 7, having a side wall 23 and a head member top wall 24. A head member slot 25 is directed into the side wall and the top wall, wherein a knife plate 27 pivotally mounted about an axle 28 in adjacency to the side wall 23 includes an axle spring 29 mounted to the axle 28 to bias the knife blade 27 in adjacency to the slot floor 26, whereupon pivoting of the knife blade 27 relative to the slot floor 26 and the slot 25 permits ease of manipulation of the knife blade for the opening of envelopes and the like.

A modified base member 11*a* is indicated in FIGS. 8 and 9, including a modified base member top wall cavity 30 directed into the top wall 12, wherein the cavity contains an ink saturated pad member 31 contained within the cavity, with a stamp plate insert 32 fixedly mounted to the support tube 13 for use as a handle permitting the stamp plate insert 32 having indicia 34 mounted to an insert bottom wall 33 permitting the imparting of a message such as return address and the like upon an envelope "E" in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An envelope moistening and service apparatus, comprising, a base member, the base member including a top wall, with a support tube mounted in communication with the top wall, wherein the support tube includes a socket cavity, and an elongate tube, with the tube having a tube first end and a tube second end, the tube having a fluid permeable wick directed through the first end and projecting through from the first end in a coaxially aligned relationship relative to the support tube, with the tube second end having a plug member, and an elongate reservoir cavity directed from the plug member to the first end, with the wick projecting into the reservoir cavity, and the plug includes a head member, and the head member is arranged for abutting engagement with the tube second end projecting laterally beyond the tube, and the head member includes a head member side wall and a head member top wall, with a slot directed through the head member top wall projecting through the head member side wall, with the slot having a slot floor, and a knife blade having a knife blade axle, with the knife blade axle mounted in the head member slot adjacent the head member side wall, with an axle spring mounted about the axle and the head member side wall for biasing the knife blade in adjacency to the slot floor, and the base member top wall includes a top wall cavity directed into the base member, and an ink saturated pad member positioned within the top wall cavity, and a stamp plate insert complementarily received within the top wall cavity, with the support tube fixedly mounted medially of the stamp plate insert to a stamp plate insert top wall, with the stamp plate insert having a stamp plate insert bottom wall, and the stamp plate insert bottom wall including indicia for engagement with the pad member for imparting an indicia reproduction upon an underlying envelope surface.

* * * * *